US005865517A

United States Patent [19]

Wang

[11] Patent Number: 5,865,517

[45] Date of Patent: Feb. 2, 1999

[54] COAT RACK AND CABINET COMBINATION

[76] Inventor: Wen-Tsan Wang, P.O. Box 82-144, Taipei, Taiwan

[21] Appl. No.: 13,307

[22] Filed: Jan. 26, 1998

[51] Int. Cl.[6] ..... A47B 83/00

[52] U.S. Cl. ..... 312/237; 312/224; 312/205; 312/6; 211/175; 211/204

[58] Field of Search ..... 312/237, 240, 312/224, 226, 227, 205, 6, 273, 249.8, 249.9; 211/175, 204, 206; 220/8

[56] References Cited

U.S. PATENT DOCUMENTS

| | | | |
|---|---|---|---|
| 334,413 | 1/1886 | Bachand | 211/175 |
| 2,885,090 | 5/1959 | Forman et al. | 211/175 |
| 2,904,383 | 7/1959 | Potts | 312/237 |
| 3,184,273 | 5/1965 | Blough | 312/6 |
| 4,984,515 | 1/1991 | Pivonka | 211/175 X |
| 5,617,962 | 4/1997 | Chen | 211/206 |
| 5,713,646 | 2/1998 | Wang | 312/6 X |

*Primary Examiner*—Peter M. Cuomo
*Assistant Examiner*—James O. Hansen
*Attorney, Agent, or Firm*—A & J

[57] ABSTRACT

A coat rack and cabinet combination includes a wheeled flat base frame, a wheeled sliding bar moved in and out of a bottom box on the wheel flat base frame, a first upright raised from the base frame and holding a mirror, a second upright raised from the sliding bar outside the base frame, the second upright having pegs for hanging clothes, a top retractable hanging tube and a bottom retractable hanging tube connected between the first upright and the second upright at different elevations, and a cabinet suspended from the top retractable hanging tube.

7 Claims, 3 Drawing Sheets

COAT RACK AND CABINET COMBINATION

BACKGROUND OF THE INVENTION

The present invention relates to a coat rack and cabinet combination which combines a coat rack and a cabinet into a compact unit.

In family, coat racks and cabinets may be provided for hanging and keeping clothes and other personal items. Because coat racks and cabinets are separate furniture and cannot be received together, must room space is required when installing coat racks and cabinets in a room.

SUMMARY OF THE INVENTION

The present invention provides a coat rack and cabinet combination which combines a coat rack and a cabinet into a compact unit. According to one aspect of the present invention, the coat rack and cabinet combination comprises a wheeled base frame, a wheeled sliding bar moved in and out of a bottom box on the wheel flat base frame, a first upright raised from the base frame, a second upright raised from the sliding bar outside the base frame, a top retractable hanging tube and a bottom retractable hanging tube connected between the first upright and the second upright at different elevations, and a cabinet suspended from the top retractable hanging tube. According to another aspect of the present invention, the second upright having pegs for hanging clothes. According to still another aspect of the present invention, the first upright holds a mirror.

DETAILED DESCRIPTION OF THE PREFERRED EMBODIMENT

Figure 1:
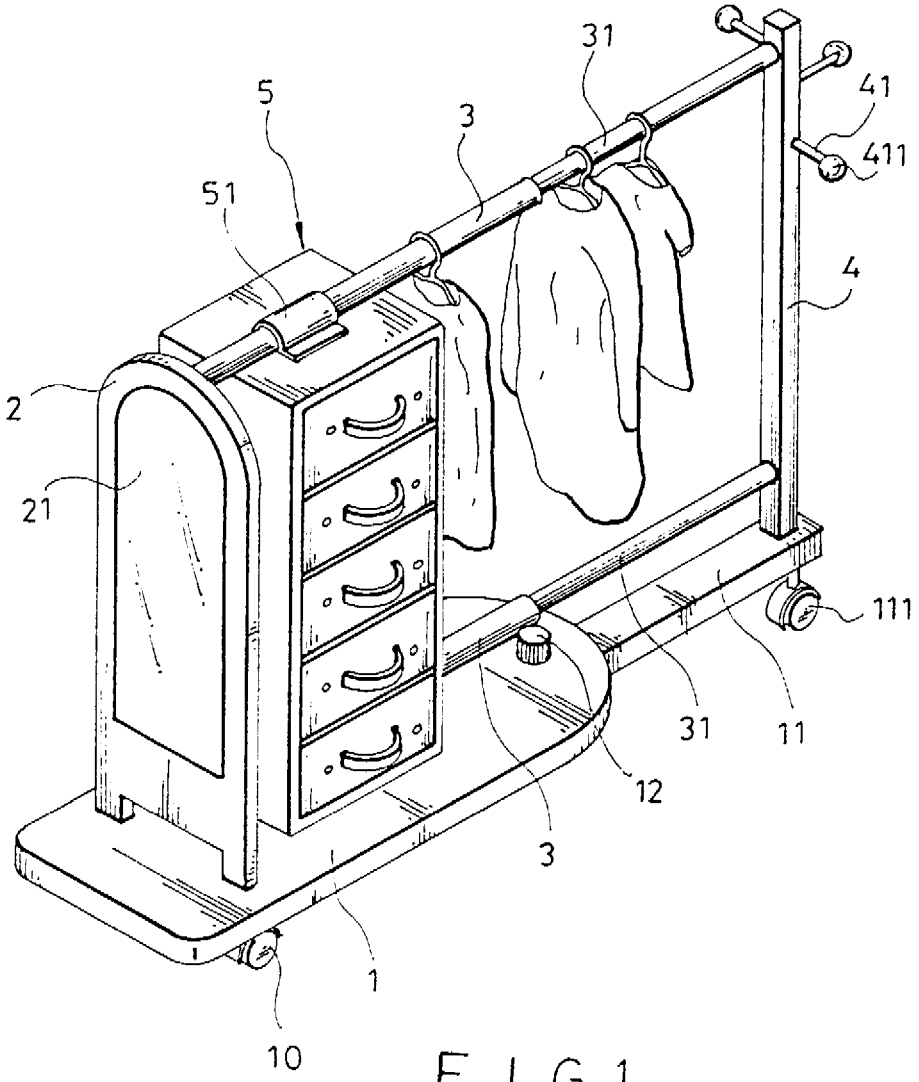
FIG. 1 is a perspective view of a coat rack and cabinet combination according to the present invention.
Figure 2:
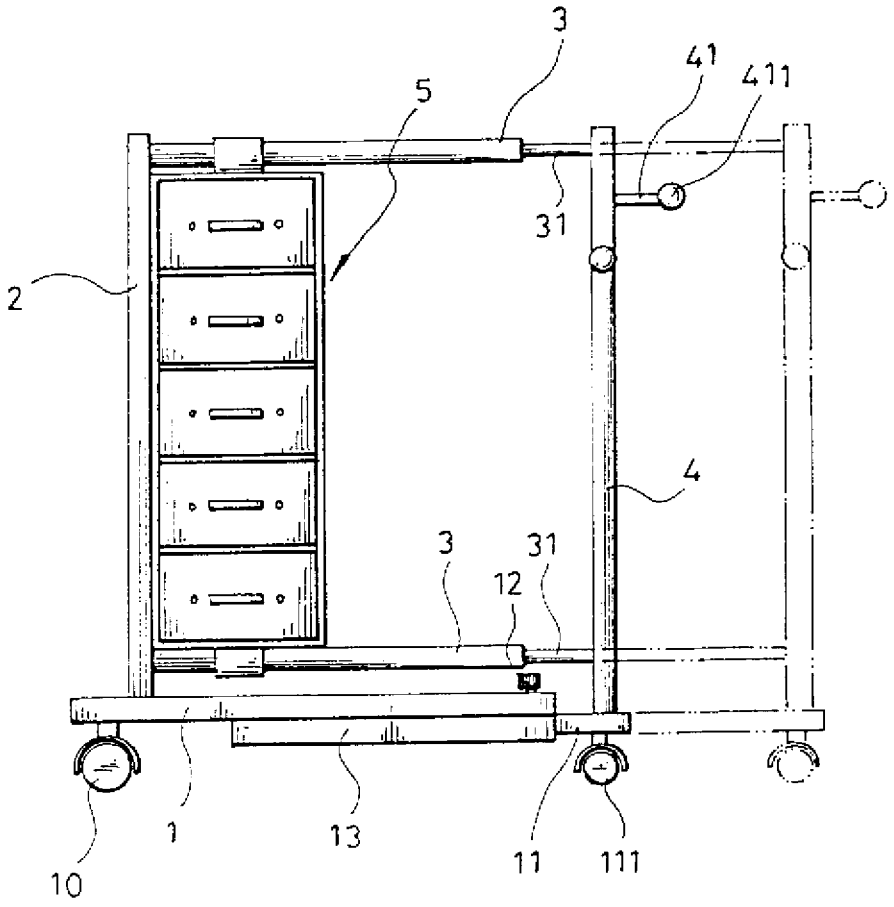
FIG. 2 is an applied view of the present invention, showing the distance between the upright mirror stand and the upright support adjusted.
Figure 3:
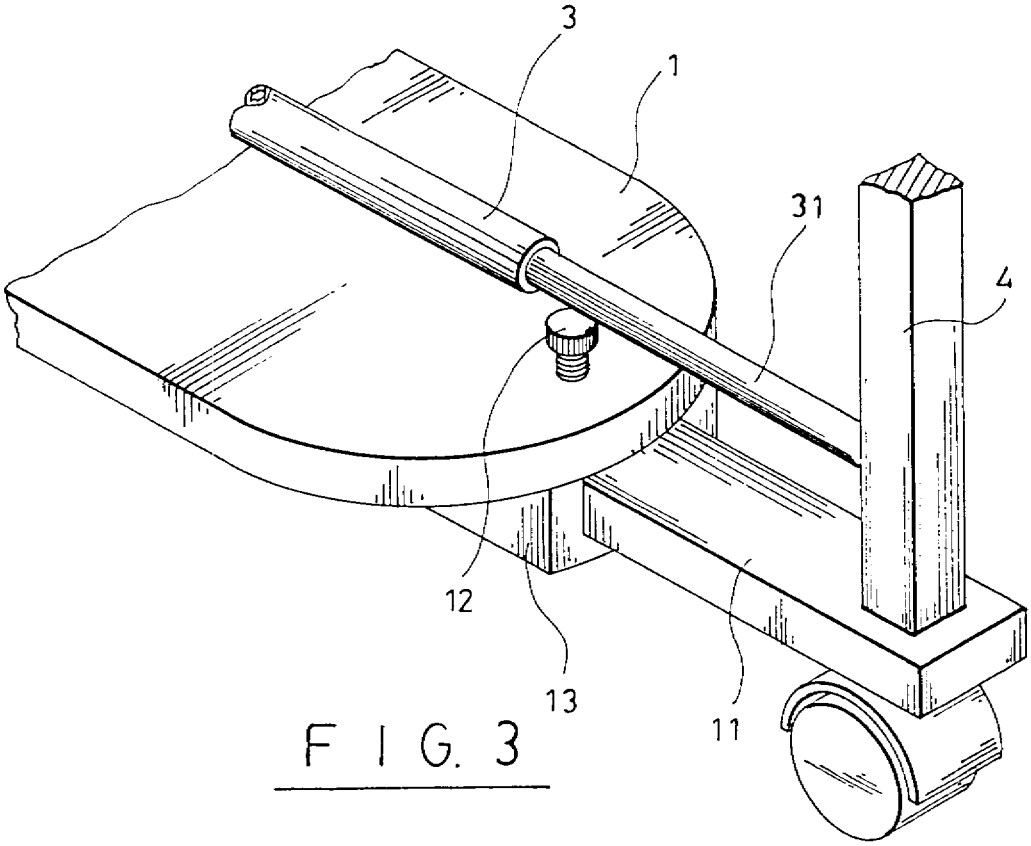
FIG. 3 is an enlarged view of a part of the present invention, showing the sliding bar coupled to the elongated box at the bottom side of the base frame and the tightening up screw mounted on the base frame.
Figure 4:
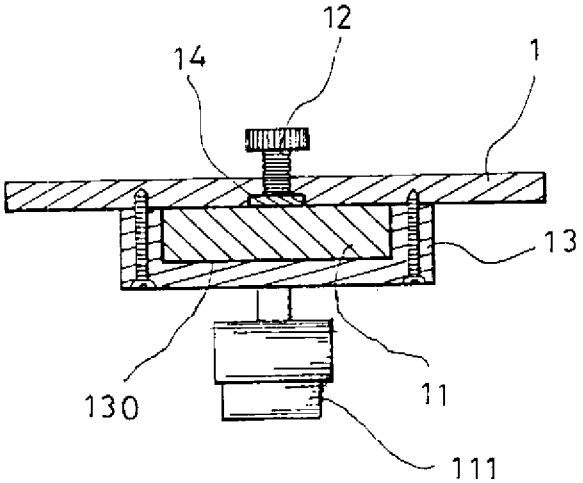
FIG. 4 is a cross sectional view of FIG. 3, showing the gasket fastened to the tightening up screw and stopped at the sliding bar.

Referring to FIGS. from 1 to 4, a coat rack and cabinet combination in accordance with the present invention comprises a flat base frame 1 having a bottom side provided with a plurality of rollers 10. An upright mirror stand 2 is mounted on the flat base frame 1 near one short side thereof. The upright mirror stand 2 holds a mirror 21. An elongated box 13 is longitudinally mounted on the bottom side of the flat base frame 1, defining a longitudinal sliding hole 130. A sliding bar 11 is slidably inserted in the longitudinal sliding hole 130. The opposite end of the sliding bar 11 which extends out of the elongated box 13 is equipped with a wheel 111. The wheels 111;10 are disposed at the same elevation so that the whole combination can be smoothly moved on the floor. A tightening up screw 12 is threaded into a screw hole (not shown) on the flat base frame 1, and controlled to fix the sliding bar 11 to the elongated box 13 at the desired position. A gasket 14 is fixedly fastened to the bottom end of the tightening up screw 12 and disposed in contact with the top side of the elongated sliding bar 11. The flat base frame 1 has a bottom recess at the bottom of the screw hole (into which the tightening up screw 12 is threaded) for receiving the gasket 14. When the tightening up screw 12 is threaded inwards, the gasket 14 is forced downwards against the sliding bar 11, thereby causing the sliding bar 11 to be fixed to the elongated box 13. An upright support 4 is raised from the free end of the sliding bar 11. The upright support 4 comprises a plurality of pegs 41 for hanging coats and the like. The pegs 41 each have a rounded head 411 that prevents a hurt to the hand when hanging coats and the like on the pegs 41. Two retractable horizontal hanging tubes are connected between the upright support 4 and the upright mirror stand 2 at top and bottom sides, each comprising an outer tube 3 and an inner tube slidably inserted into the outer tube 3. A cabinet 5 is mounted between the outer tubes 3 of the retractable horizontal hanging tubes, having a hanger 51 at the top hung on the outer tube 3 of the top-sided retractable horizontal hanging tube.

Referring to FIGS. from 2 to 4 again, when the tightening up screw 12 is loosened, the sliding bar 11 is released and can be moved in and out of the elongated box 13 to adjust the distance between the upright support 4 and the upright mirror stand 2. After adjustment, the tightening up screw 12 is fastened tight again to fix the sliding bar 11 in position.

While only one embodiment of the present invention has been shown and described, it will be understood that various modifications and changes could be made thereunto without departing from the spirit and scope of the invention disclosed.

What the invention claimed is:

1. A coat rack and cabinet combination comprising:

a flat base frame;

a first upright support means raised from said flat base frame;

a sliding bar having a first end slidably inserted into a horizontal hole on said flat base frame and a second end extended out of said flat base frame;

a second upright support means raised from the second end of said sliding bar, said second upright support having pegs for hanging clothes;

a top horizontal hanging tube and a bottom horizontal hanging tube connected between said first upright support means and second upright support means at different elevations above said flat base frame; and a cabinet suspended from said top horizontal hanging tube above said bottom horizontal hanging tube.

2. The coat rack and cabinet combination of claim 1, wherein said flat base frame and the free end of said sliding bar are equipped with a plurality of wheels for moving on the floor.

3. The coat rack and cabinet combination of claim 1, wherein said top horizontal hanging tube and said bottom horizontal hanging tube each comprises an outer tube connected to said first upright support means, and an inner tube having one end slidably inserted into the corresponding outer tube and an opposite end connected to said second upright support means.

4. The coat rack and cabinet combination of claim 1, wherein said flat base frame comprises an elongated box at a bottom side thereof, said elongated box defining an elongated sliding hole which receives said sliding bar.

5. The coat rack and cabinet combination of claim 4 further comprising lock means controlled to fix the first end of said sliding bar to said flat base frame.

6. The coat rack and cabinet combination of claim 5, wherein said lock means comprises a screw hole pierced through said flat base frame and said elongated box in communication with the elongated sliding hole in said elongated box, a tightening up screw threaded into said screw hole, and a gasket fixedly fastened to said tightening up screw and disposed in contact with the fixed end of said sliding bar.

7. The coat rack and cabinet combination of claim 1, wherein said first upright support means holds a mirror.

* * * * *